US012403407B2

(12) United States Patent
Frankowski et al.

(10) Patent No.: US 12,403,407 B2
(45) Date of Patent: Sep. 2, 2025

(54) ROTATING AMUSEMENT WATER RELATED FEATURE

(71) Applicant: WHITEWATER WEST INDUSTRIES, LTD., Richmond (CA)

(72) Inventors: Hyuma Frankowski, Vancouver (CA); Kelly Williams, Delta (CA); Ross Flavell, Coquitlam (CA); Geoff Chutter, Vancouver (CA); Ryan Sinitsin, Osaka (JP); Bruce Bradley, Vancouver (CA); Ben Cornwell-Mott, Comox (CA); Claudio Barrera, White Rock (CA)

(73) Assignee: WHITEWATER WEST INDUSTRIES, LTD., Richmond (CA)

( * ) Notice: Subject to any disclaimer, the term of this patent is extended or adjusted under 35 U.S.C. 154(b) by 185 days.

(21) Appl. No.: 18/055,824

(22) Filed: Nov. 15, 2022

(65) Prior Publication Data

US 2023/0415049 A1 Dec. 28, 2023

Related U.S. Application Data

(60) Provisional application No. 63/264,090, filed on Nov. 15, 2021.

(51) Int. Cl.
*A63G 21/18* (2006.01)
*A63G 21/10* (2006.01)

(52) U.S. Cl.
CPC ..... *A63G 21/18* (2013.01); *A63G 21/10* (2013.01)

(58) Field of Classification Search
None
See application file for complete search history.

(56) References Cited

U.S. PATENT DOCUMENTS

| | | | | |
|---|---|---|---|---|
| 913,243 | A * | 2/1909 | Sonntag | A63G 7/00 104/57 |
| 5,433,671 | A | 7/1995 | Davis | |
| 8,012,031 | B2 * | 9/2011 | Stuart | A63G 3/02 472/117 |
| 9,440,155 | B2 | 9/2016 | Fischer | |
| 11,141,666 | B2 * | 10/2021 | Chutter | A63G 21/18 |
| 2006/0111196 | A1 | 5/2006 | Henry | |

(Continued)

FOREIGN PATENT DOCUMENTS

| | | | |
|---|---|---|---|
| CN | 108310778 | A | 7/2018 |
| WO | 9845006 | A1 | 10/1998 |
| WO | 2009141588 | A2 | 11/2009 |

(Continued)

OTHER PUBLICATIONS

International Search Report and Written Opinion for International Application No. PCT/CA2022/051688, dated Jan. 19, 2023, 10 pages.

*Primary Examiner* — Joseph A Dillon, Jr.
(74) *Attorney, Agent, or Firm* — Buchalter, a Professional Corporation

(57) ABSTRACT

A ride structure is disclosed using rotating tunnel sections as part of a static water ride with or without variations in the tunnel cross-section and/or embedded three-dimensional features to disturb the water paths which carries vehicles with riders. The riders may exit the rotating large tunnel upstream and downstream and the volume and velocity of the water can be manipulated to change the ride experience.

13 Claims, 13 Drawing Sheets

(56) References Cited

U.S. PATENT DOCUMENTS

| | | | | |
|---|---|---|---|---|
| 2009/0105003 | A1 | 4/2009 | Stuart et al. | |
| 2021/0228991 | A1 * | 7/2021 | Kulkarni | A63G 21/18 |

FOREIGN PATENT DOCUMENTS

| | | | |
|---|---|---|---|
| WO | 2011119120 | A1 | 9/2011 |
| WO | 2013066155 | A1 | 5/2013 |
| WO | 2013144117 | A1 | 10/2013 |
| WO | 2014073952 | A1 | 5/2014 |
| WO | 2022082293 | A1 | 4/2022 |
| WO | 2023082028 | A1 | 5/2023 |

* cited by examiner

ROTATING AMUSEMENT WATER RELATED FEATURE

CROSS REFERENCE TO RELATED APPLICATIONS

This application claims priority from U.S. provisional patent application Ser. No. 63/264,090, dated Nov. 15, 2021.

BACKGROUND

Typically, experiences in water slides occur on static surfaces on which vehicles or riders are transported along a slide path with moving water as a transportation conduit. Even adventure river rides are static in nature in that the water moguls used to create turbulence are static. Adding movement of the riding surface by a laterally rotating surface, optionally in connection with varying interior cross-sections of the rotating surface and/or three-dimensional obstacles or moguls introduces new rider experience dimensions not seen on other water slides.

The amusement water related industry is constantly seeking new ride experiences from the market to draw in new clients and to keep their attractions fresh and interesting in their local market. Previous attempts to introduce a new type of ride have included water slides that have rotation movement; however, those prior solutions were limited to keeping riders on a set ride path with the water slide moving underneath them, usually in a direction aligned with their direction of travel. Thus, the ride was limited to a constant cross slide section (such as a flume) that affects only the forward and backward motion of the rider by forcing the rider along a path where the vertical and forward/backward motion of that ride is created by the longitudinal rotation of the structure.

Previous attempts also were also limited to a smooth riding surface with no variations in water depth or slide surface cross-section. By contrast, this disclosure presents exemplary embodiments that are dynamic and may be incorporated in line with, or as one feature in, a larger water ride, rather than just as a standalone feature or as a separate part of a river complex at the amusement park.

References describing previous attempts to address moving slides include WO2009/141588, U.S. Pat. No. 5,433,671, WO1998/045006, U.S. Pat. No. 9,440,155, and WO2013/144117, which are incorporated herein in their entirety. However, these descriptions do not disclose a slide with the advantageous features described herein.

As described herein, the invention includes rotating waterslide features that can be incorporated in-line with a water slide flume. Unlike prior inventions, the invention described herein induces and incorporates sideways or lateral motion of the rider (i.e., pushing the rider up a wall) to increase excitement and enjoyment by the riders. This invention affects the sideways or lateral motion of a rider (pushing them up the wall). This and additional features and embodiments are described herein.

BRIEF SUMMARY OF THE INVENTION

The invention seeks to add another dimension of experience to riders in a water slide or related water amusement feature.

The invention includes a large rotating tunnel section of a water slide that may also include embedded three-dimensional shapes or variations in the rotating tunnel cross-section to disturb the water path. Exemplary embodiments describe a rotating section that connects upstream and downstream to a static water slide which carries vehicles with riders and the water channel used to transport them. In one embodiment, the volume and velocity of the water entering the barrels is such that it creates a white water rafting experience within the rotating barrel. In another embodiment, the volume and velocity of the water entering the barrels may be significantly less. For example, the water may be sufficient only to wet the surface of the ride.

These and other embodiments of the present invention will become apparent to those skilled in the art from a consideration of the following detailed description taken in combination with the accompanying drawings and by the elements, features, and combinations particularly pointed out in the claims.

BRIEF DESCRIPTION OF THE DRAWINGS

Example embodiments will be described and explained with additional detail provided through the use of the accompanying drawings.

DETAILED DESCRIPTION OF THE INVENTION

While certain embodiments have been provided and described herein, it will be readily apparent to those skilled in the art that such embodiments are provided by way of example only. It should be understood that various alternatives to the embodiments described herein may be employed, and are part of the invention described herein The following detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention. It should be understood that the drawings are diagrammatic and schematic representations of exemplary embodiments of the invention, and are not limiting of the present invention nor are they necessarily drawn to scale.

Exemplary embodiments described herein would be unique in the industry with visual appeal due to the rotation and dynamics of the ride.

Throughout this description, it should be understood that the term "ride vehicle" refers to a ride vehicle (e.g., a raft) carrying a single rider or multiple riders as is commonly used in the industry. It is also contemplated that a rider riding without a vehicle may enjoy the inventions described herein, notwithstanding the use of the term "vehicle" in the description.

Figure 1A:
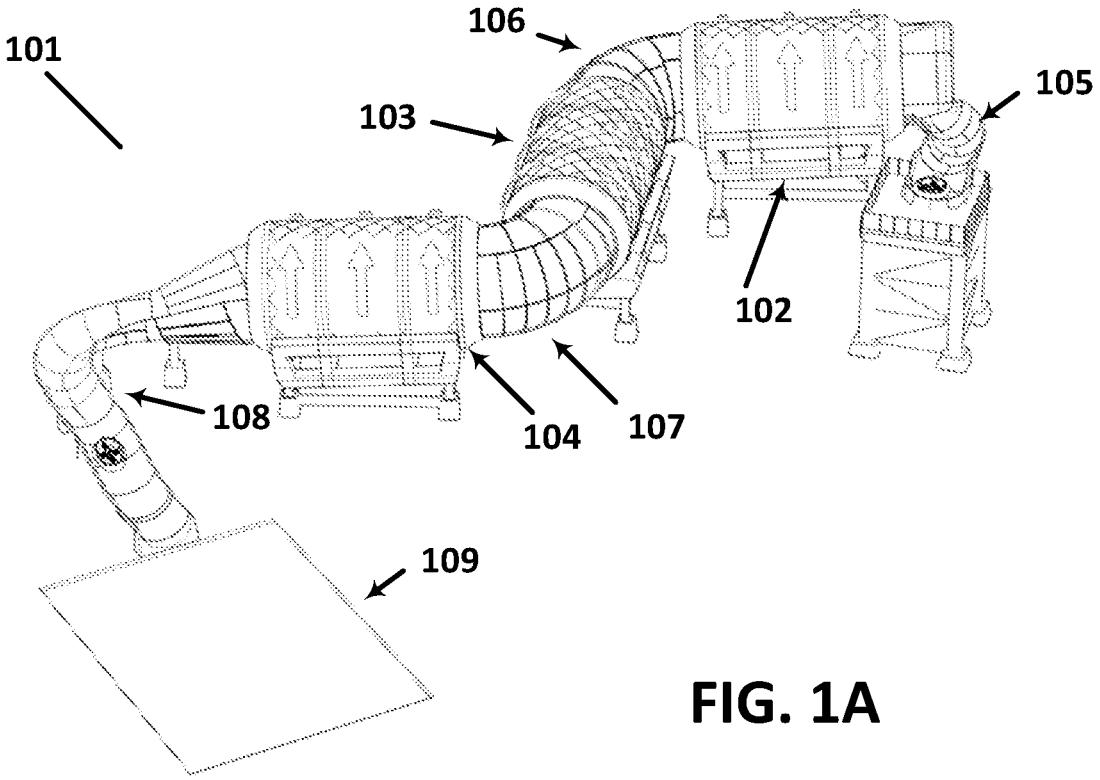
FIGS. 1A and 1B illustrate an example ride configuration that incorporates three rotating features.
Figure 1B:
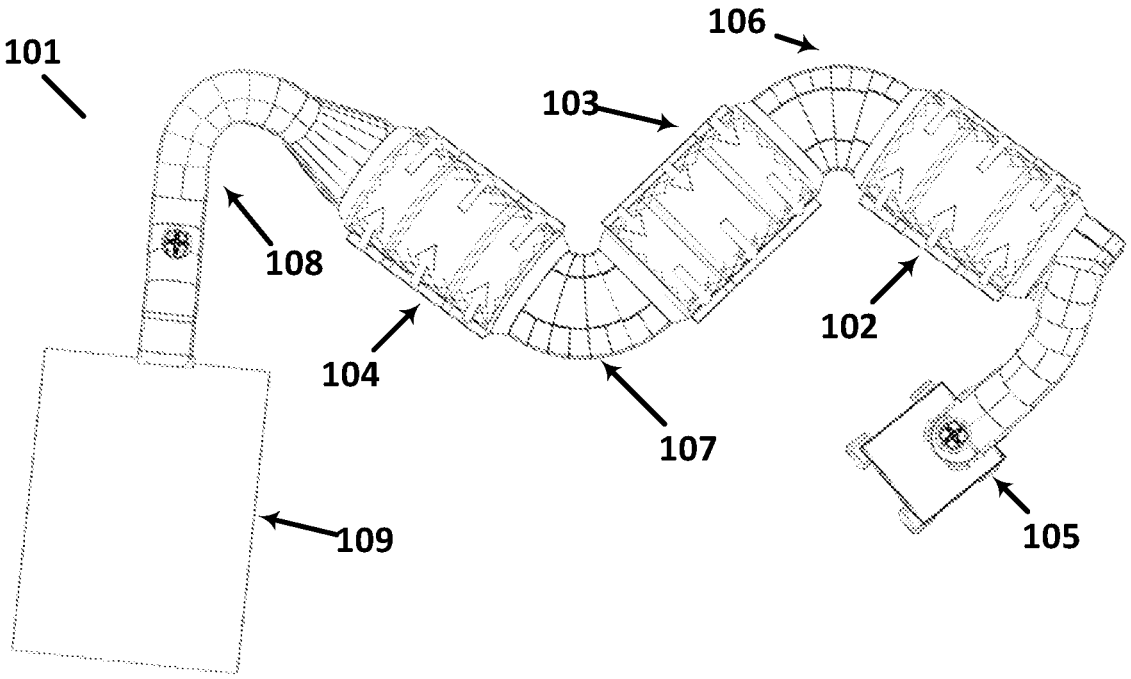

FIG. 1A is a perspective view of a ride incorporating three rotating features in accordance with one embodiment of this invention. FIG. 1B is an overhead view of the same exemplary embodiment of a ride depicted in FIG. 1A.

FIGS. 1A and 1B illustrate an exemplary embodiment (101) depicting example configurations of the rotating features (102, 103 and 104). As depicted in the embodiment in FIGS. 1A and 1B, a first rotating feature (102) follows a drop shortly after the entrance to the ride (105) before entering the first rotating feature (102). Upon exiting the first rotating feature (102) the rider enters an intermediate section of the ride (106) which leads into a second rotating feature (103). Upon exiting the second rotating feature (103), the ride vehicle enters a second intermediate section of the ride (107) which leads into a third rotating feature (104). Upon exiting the third rotating feature (104), the ride vehicle exits the ride via a third intermediate feature (108) and into a pool (109) or shutdown lane.

The intermediate sections (106, 107, 108) of the ride are depicted in FIGS. 1A and 1B as a closed flume. However, the intermediate section may be an open flume, conveyor, bowl feature, dropoff, lazy river, or any other ride feature known in the art.

In other embodiments of the ride, the rotating feature may be entered directly from the ride entry, directly proceed or follow another rotating feature, exit directly into a pool or shutdown lane, and/or directly or indirectly proceed or follow another ride feature.

The angle of inclination (grade) of the rotating features (102, 103 and 104) may be determined based on the target tangential velocity of the ride vehicles, a steeper grade may be used to speed up the ride vehicle and a shallower grade may be used to slow down the ride vehicle.

FIGS. 1A and 1B illustrate example entry angle and speed configurations of the rotating features (102, 103 and 104). As illustrated, rotating feature (102) may be entered with an entry angle close to 90 degrees from the rotating feature's central longitudinal axis (i.e., the axis about which the feature rotates) with high speed, for example following a drop used to increase ride vehicle speed. Rotating feature (103) illustrates the rotating feature may be entered with an entry angle close to the central longitudinal axis of the rotating feature with low speed. In other embodiments the entry angle may be between 0 and 90 degrees from the rotating features central longitudinal axis.

As more easily seen in FIG. 1B the rotating features (102, 103 and 104) may rotate clockwise (102 and 104) or anticlockwise (103) (as viewed by a forward-facing rider traveling through the rotating feature), as indicated by the arrows on each rotating feature.

The rotating features (102, 103 and 104) may constantly rotate at a set speed or may have varying rotation speed to create varying experiences. In an exemplary embodiment the varying rotation speed of the rotating feature may be controlled electronically using variable frequency drives (VFDs) or similar technology used to control the drive speed of the motor or similar technology. In one embodiment, the varying rotation speed of the rotation feature may be controlled by maintaining a constant drive speed of the motor or similar technology and using mechanical systems, for example oval gearing, offset gearing or cams, continuously variable transmissions (CVTs) or similar technology to gear up or down the rotation speed applied to the rotating feature. In one embodiment, the varying rotation speed of the rotating feature may be controlled by using a combination of electronic and mechanical speed control systems.

In one exemplary embodiment the rotating features (102, 103 and 104) illustrated in FIGS. 1A and 1B may be indirectly driven. For example, the rotating feature includes one or more v-grooves for a belt drive system, or one or more gears for a chain drive or geared system, or the rotating feature may rest on one or more drive wheels that support and spin the tunnel on collars (205 or 206 shown in FIG. 2C), or similar technology. In one embodiment, the rotating features (102, 103 and 104) may be directly driven with a straight shaft. In one embodiment, the rotating features (102, 103 and 104) may be directly driven with a straight shaft and flexible coupling or similar technology.

Figure 2A:
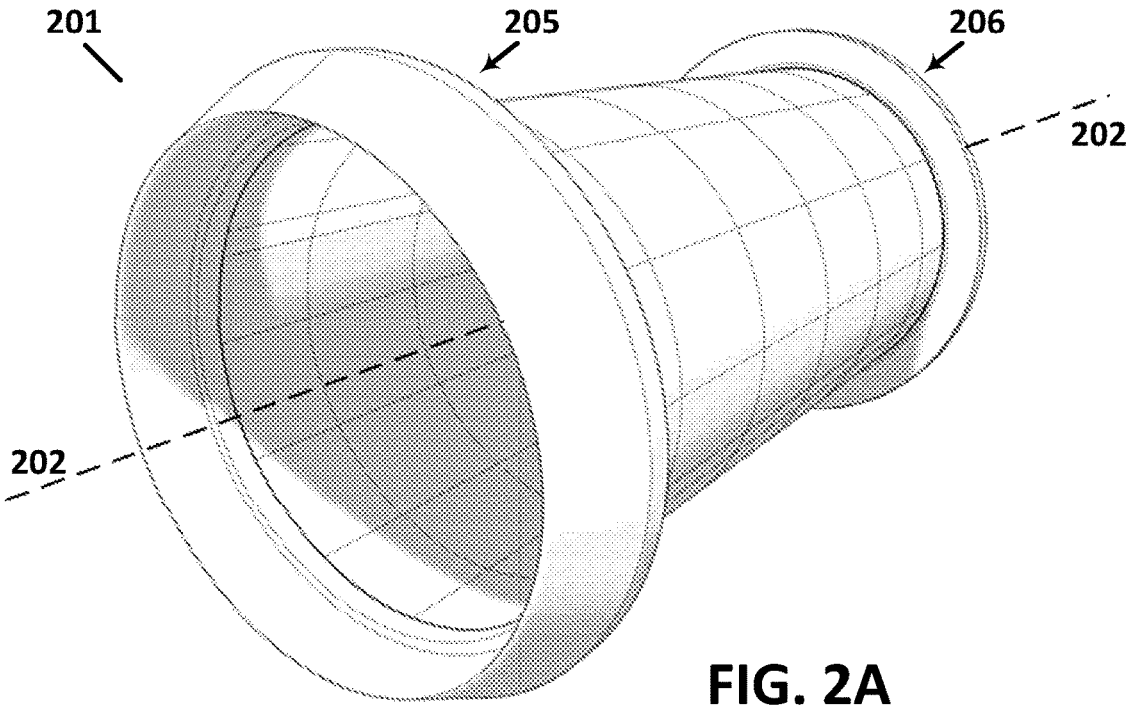
FIGS. 2A, 2B and 2C illustrate an exemplary embodiment of the rotating feature with a constant cross-sectional diameter following a central axis.
Figure 2B:
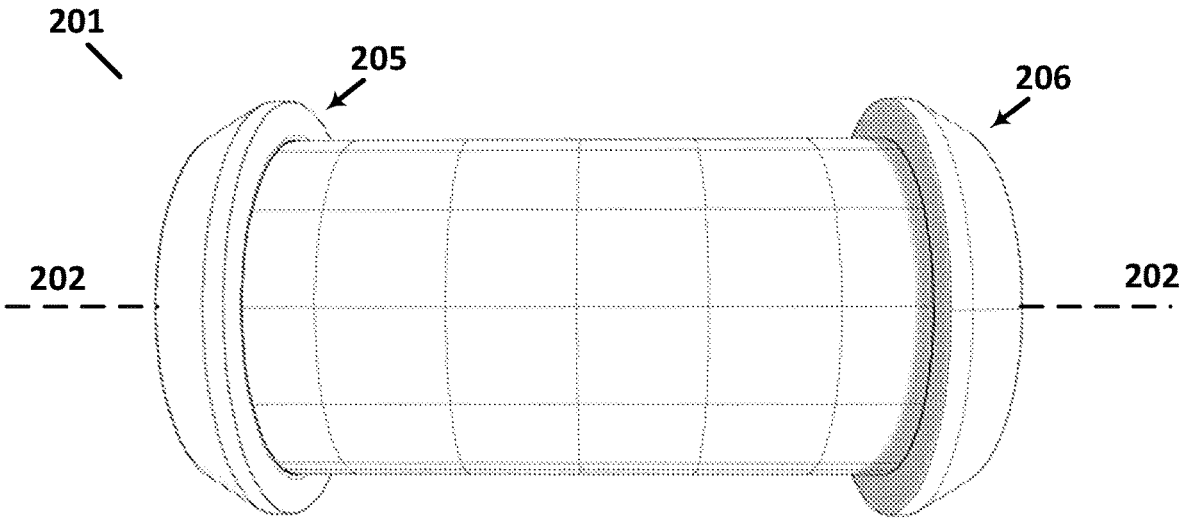
Figure 2C:
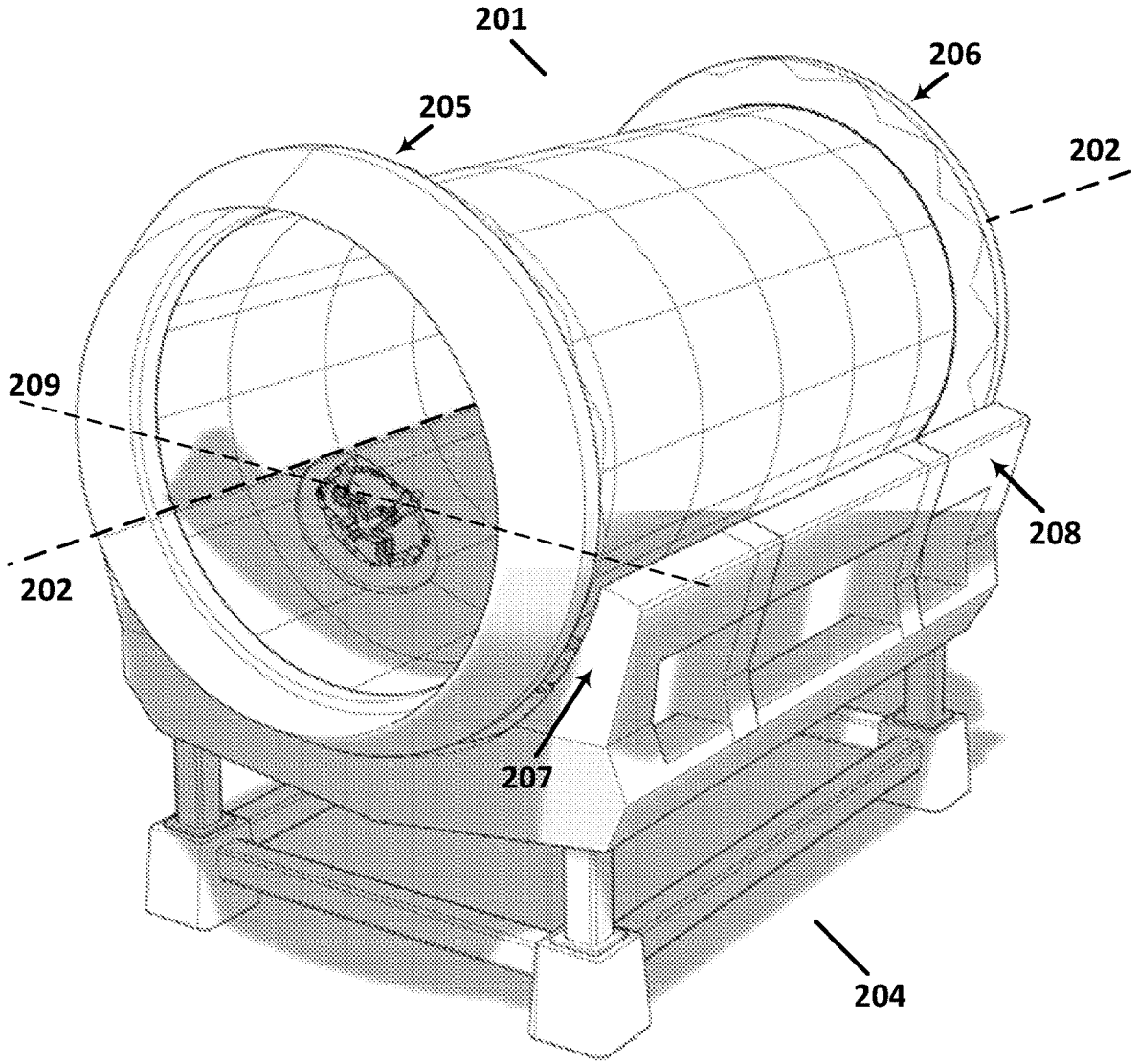

FIGS. 2A, 2B and 2C illustrate an exemplary embodiment of a rotating feature (201) with a constant cross-sectional diameter following a central axis (202). It is contemplated that the exemplary embodiment (201) or similar alternative embodiments may be used in place of any or all of the rotating features (102, 103 and 104) shown in FIG. 1A or alternative ride configurations.

As shown in FIG. 2A, the cross-sectional diameter of the interior of the rotating feature (201) is constant throughout. The exterior diameter also exhibits a constant cross-sectional diameter, apart from the collar sections (205, 206) on each end. However, it is contemplated that the exterior diameter may also be adapted to have a non-uniform cross-section, while the interior cross-section remains uniform as shown. For example, the exterior diameter in this embodiment and other described herein may include design features (arrows, logos, theming, etc.) or utilitarian features (notches, grooves, gearing, etc.) that assist in the rotation.

FIG. 2C illustrates an exemplary embodiment of a rotating feature (201) with collar structures (205 and 206) towards the end of the rotating feature and an open pedestal (204) supporting the rotating feature (202). The collar structures (205, 206) are designed to constrain the rotating feature (201) laterally along the central axis (202) by opposing features (207, 208) on the pedestal (204). In one embodiment, the rotating feature (201) may be constrained coaxially around the central axis (203) by partially or entirely enclosing the collar structures (205 and 206) and positioning guide wheels above the mid-point (209) of the rotating feature. In one embodiment, the support structures may have an I-beam or similar cross-section that travels through a set of guide wheels used to constrains the coaxially and laterally along the central axis (203). In one embodiment, the rotating feature (201) may be enclosed in a large cylindrical structure such that the rotating feature, drive system, collars, etc., cannot be seen from the outside.

Figure 3A:
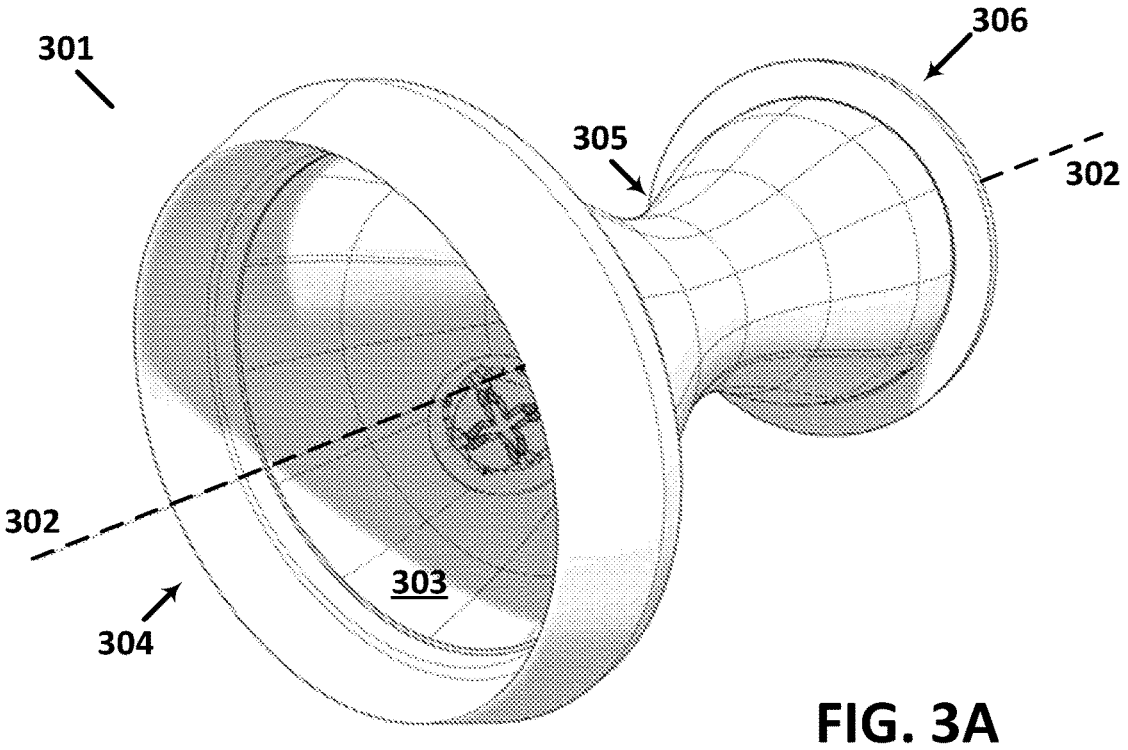
FIGS. 3A and 3B illustrate an exemplary embodiment of the rotating feature with a varying cross-sectional diameter following a central axis.
Figure 3B:
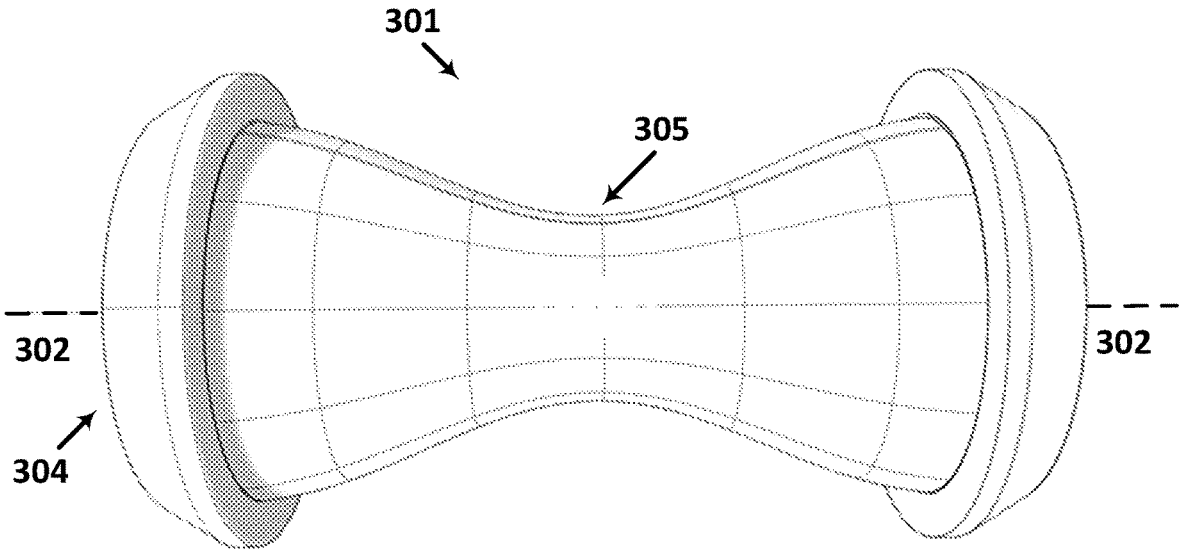

FIGS. 3A and 3B illustrate an exemplary embodiment of the rotating feature (301) with a varying cross-sectional diameter following a central longitudinal axis (302). It is contemplated that the exemplary embodiment of the ride feature (301) or similar alternative embodiments may be used in place of any or all of the rotating features (102, 103 and 104) shown in FIG. 1A or alternative ride configurations.

FIGS. 3A and 3B illustrate an exemplary embodiment (301) of the rotating feature with a varying cross-sectional diameter following a central axis (302). Varying the cross-sectional diameter of the inner ride surface (303) allows the designer to change the gradient of the ride surface (303) without changing the gradient of the central axis (302) of the rotating feature. For example, by reducing the cross-sectional diameter from a large cross-sectional diameter at the extreme ends, for example, entering at the end with collar 304 in FIG. 3A, to a smaller cross-sectional diameter in the interior (305), the ride surface gradient will reduce or invert and ride vehicles will slow down. And by increasing the cross-sectional diameter again from a small cross-sectional diameter in the interior (305) to a large cross-sectional diameter at the far end (the end with collar 306), the ride surface gradient will increase and the ride vehicles will speed up.

Although FIGS. 3A and 3B illustrate an exemplary embodiment of the rotating feature (301) with a large cross-sectional diameter at the entrance (304) and exit (306) of the rotating feature and a small cross-sectional diameter in the middle (305) of the rotating feature, other embodiments with varying cross-sections are contemplated. In one embodiment, the entrance (304) and exit (305) of the rotating feature may have a comparatively small cross-sectional diameter compared to the middle (305) of the rotating feature. In one embodiment, the cross-sectional diameter of the rotating feature may get larger or smaller, either in a linear or non-linear manner, from the entrance (304) to the exit (306) (e.g., a conical feature or a horn-shaped feature). In one embodiment, the cross-sectional diameter of the rotating feature may increase and/or decrease more than once: for example the entrance (304) may have a large cross-sectional diameter, then the cross-sectional diameter may decrease, then increase, then decrease and finally increase to a large cross-sectional diameter at the exit (306).

In an alternative embodiment, the cross-sectional shape, not just diameter, of the rotating feature may change along its length. For example, rather than narrowing at the center point, the rotating feature shown in FIGS. 3A and 3B may alternatively change from a circular cross section at the extreme ends to a triangular (or rectangular, pentagonal, etc.) cross-section at an interior point, and then back to a circular cross-section. In other embodiments, the cross-section may change to multiple different shapes along the length of the rotating feature.

Figure 4A:
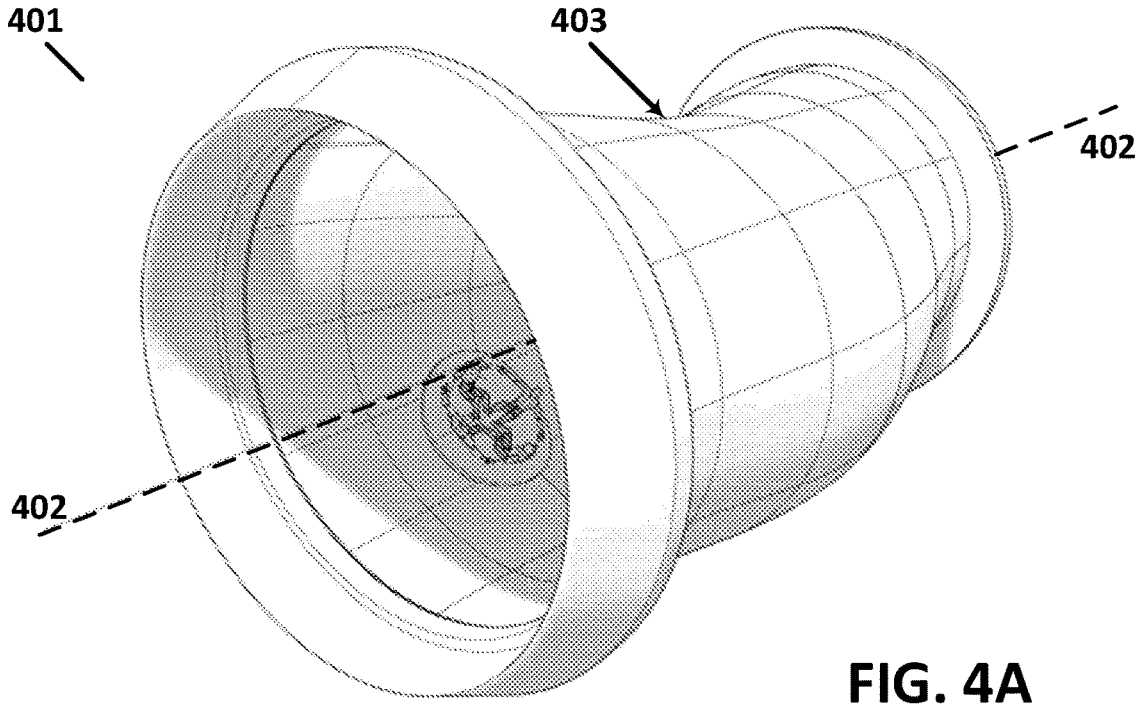
FIGS. 4A and 4B illustrate an exemplary embodiment of the rotating feature with a cross-section following a curved spline.
Figure 4B:
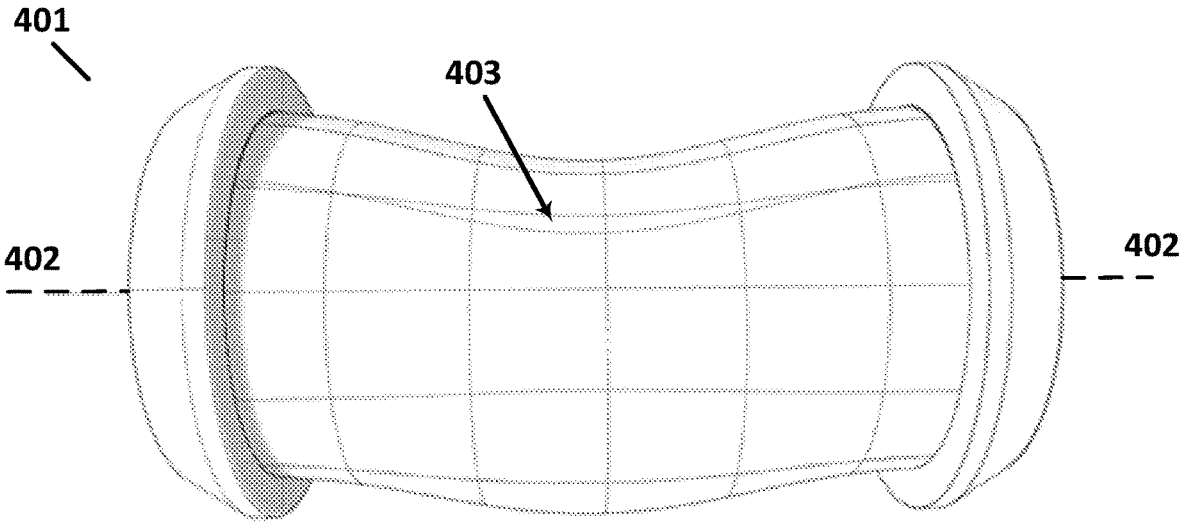

FIGS. 4A and 4B illustrate an exemplary embodiment (401) of the rotating feature with a cross-section following a curved spline (403). It is contemplated that the exemplary embodiment of the ride feature (401) or similar alternative embodiments may be used in place of any or all of the rotating features (102, 103 and 104) shown in FIG. 1A or alternative ride configurations.

FIGS. 4A and 4B illustrate an exemplary embodiment (401) of the rotating feature with a constant cross-sectional diameter following a 2-dimensional curved spline (403). In one embodiment, the spline may be three-dimensional. In one embodiment, the spline may not be a smooth curve, but may be made up of two or more straight lines at different angles to the central axis (402) of the rotating feature. In one embodiment, the cross-sectional diameter may also vary along the spline (403) similar to FIGS. 3A and 3B, such that the diameter gets larger and smaller at the same time the spline varies.

Figure 5A:
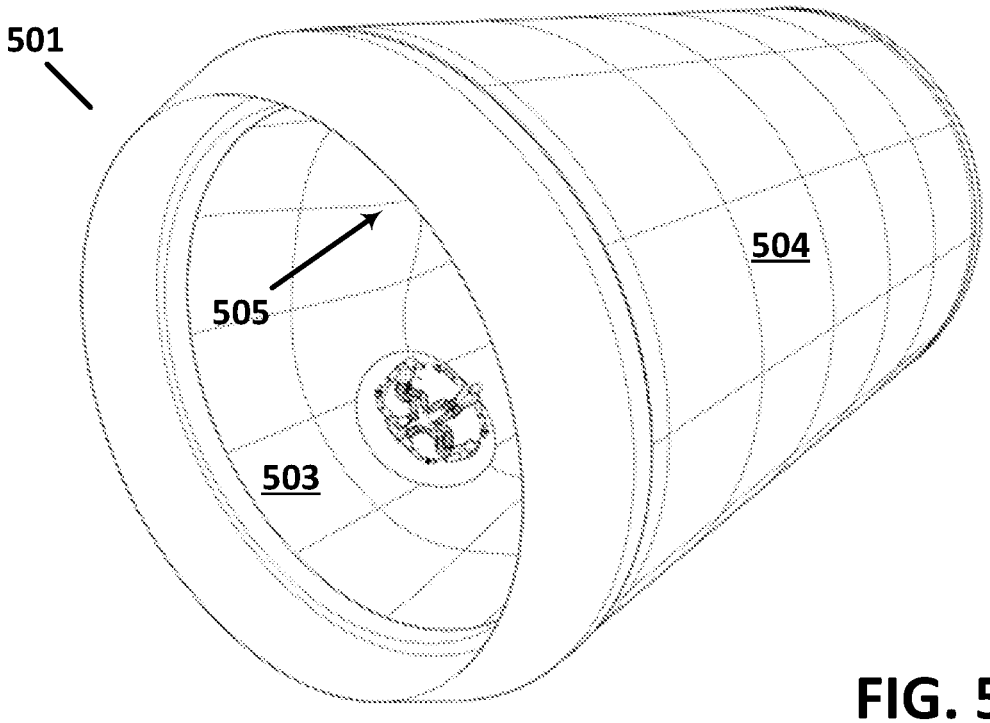
FIGS. 5A and 5B illustrate an exemplary embodiment of the rotating feature with three-dimensional features on the inner ride surface.
Figure 5B:
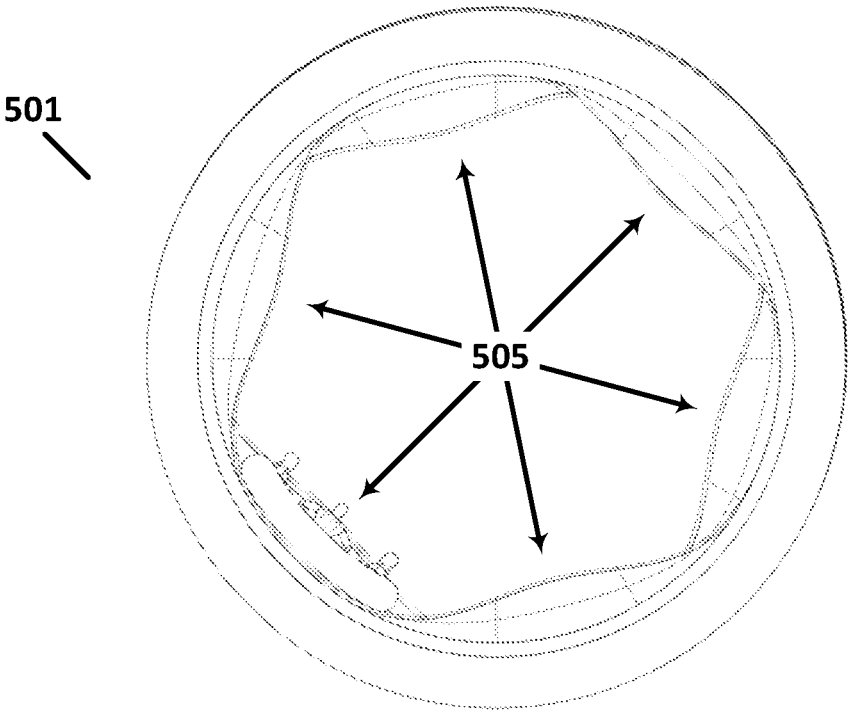

FIGS. 5A and 5B illustrate an exemplary embodiment (501) of the rotating feature with three-dimensional features (505) on the inner ride surface (503) that may cause turbulence within the water channel. It is contemplated that the exemplary embodiment of the ride feature (501) or similar alternative embodiments may be used in place of any or all of the rotating features (102, 103 and 104) shown in FIG. 1A or alternative ride configurations.

FIGS. 5A and 5B illustrate an exemplary embodiment (501) of the rotating feature with an outer surface (504) with a constant cross-sectional diameter following a central axis and three-dimensional features (505) formed on the inner surface (503). As depicted in FIGS. 5A and 5B, the three-dimensional features (505) are uniform in size and shape and are uniformly distributed along the circumference and along the length of the rotating feature (501). In other embodiments, the three-dimensional features (505) may be non-uniform, either in shape, size, or location, or with respect to all three aspects.

In one embodiment, the three-dimensional features (505) are integrally formed in the inner surface (503) of the rotating feature. In other embodiments, the three-dimensional features (505) attached to the inner ride surface (503) may be removed or swapped for other three-dimensional features of the same or different shape and size.

FIGS. 5A and 5B illustrate an exemplary embodiment (501) of the rotating feature with smooth hemi-sphere shaped three-dimensional features (505). In one embodiment, the three-dimensional features (505) may vary in shape and size for example long paddles, tall and short ellipses, or tunneled/arch features.

FIGS. 5A and 5B illustrate an exemplary embodiment (501) of the rotating feature with a cross-sectional diameter following a central axis. In one embodiment, the cross-sectional diameter may follow a spline, such as feature 403 depicted in FIGS. 4A and 4B. In one embodiment, the cross-sectional diameter may vary along the central axis or spline similar to FIGS. 3A and 3B.

FIGS. 6A through 6E illustrate an exemplary embodiment (601) of the rotating feature that incorporates an open feature (607) and can rotate clockwise (FIG. 6C) and anti-clockwise (FIG. 6E) as viewed by a front-facing rider traveling through the feature. It is contemplated that the exemplary embodiment of the ride feature (601) or similar alternative embodiments may be used in place of any or all of the rotating features (102, 103 and 104) shown in FIG. 1A or alternative ride configurations.

Figure 6A:
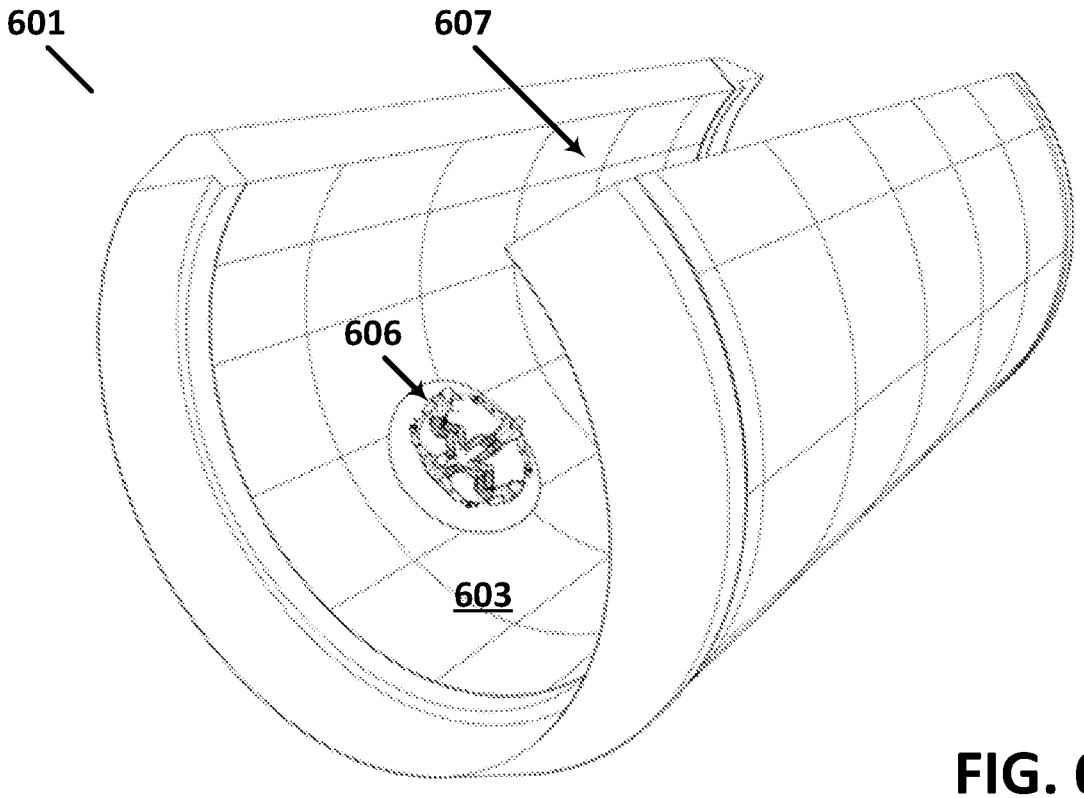
FIGS. 6A, 6B, 6C, 6D and 6E illustrate an exemplary embodiment of an open rotating feature that can rotate clockwise and anticlockwise.
Figure 6B:
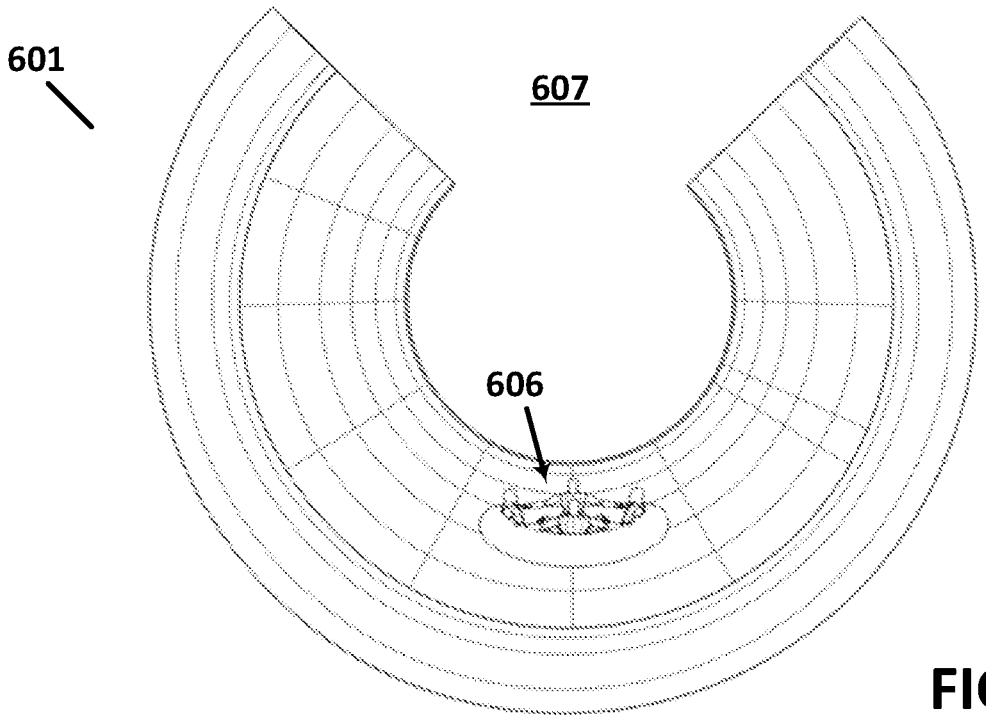
Figure 6C:
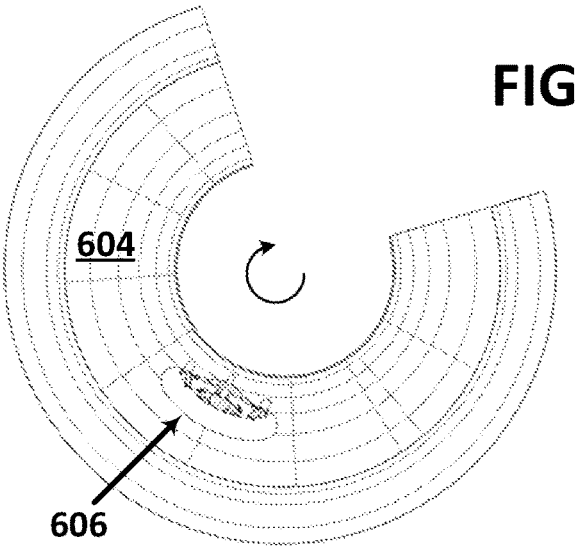
Figure 6D:
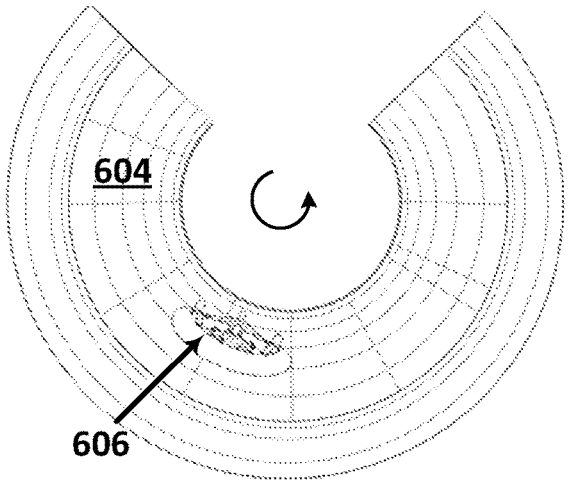
Figure 6E:
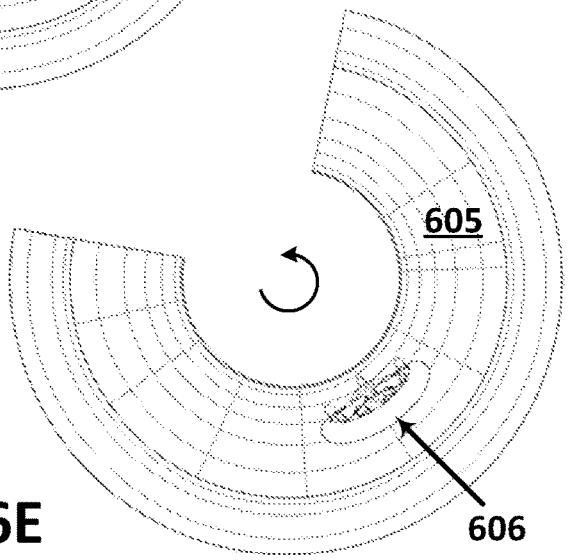

FIG. 6A illustrates a perspective view of an exemplary embodiment of the rotating feature (601) in a neutral position. FIG. 6B illustrates an end view of the rotating feature (601) with the feature and ride vehicle (606) in a neutral position. As illustrated in FIGS. 6C, 6D and 6E as the rotating feature rotates clockwise (FIG. 6C) the ride vehicle (606) begins to climb the riding surface wall (604) due to the friction between the ride vehicle (606) and riding surface (603). As the rotation direction changes to anticlockwise (FIG. 6D) the ride vehicle (606) may continue to climb the riding surface wall (604) before gravitational forces overcome the friction forces and stall the ride vehicle (606) on the wall (604) and the ride vehicle (606) changes direction. As the rotating feature (601) continues to rotate anti-clockwise, the ride vehicle begins to drop toward the neutral position and then begin climbing the second surface wall (605). The open feature (607) enhances the riders' perception of movement and change of direction of rotation.

In one embodiment, the rotating feature (601) in FIG. 6A may replace rotating feature 102 in FIG. 1A. In that instance, the ride vehicle (606) would preferably enter the rotating feature (601) with moderate to high speed and an entry angle close to 90 degrees from the central axis of the rotating feature (601) and immediately climb the first ride surface wall (604). The clockwise (FIG. 6C) and anticlockwise (FIG. 6E) rotation of the rotating feature (601) may be used to maintain or dampen the oscillation of the ride vehicle (606) on the ride surface walls (604, 605).

In one embodiment, the rotating feature (601) in FIG. 6A may replace rotating features 103 and/or 104 in FIG. 1A. In that case, the ride vehicle (606) would likely enter the rotating feature (601) with low speed and an entry angle close to the central axis of the rotating feature (601), the clockwise (FIG. 6C) and anticlockwise (FIG. 6E) rotation of the rotating feature (601) may be used to build up the oscillation of the ride vehicle (606) on the ride surface walls (604 and 605).

The exemplary embodiment of the rotating feature (601) illustrated in FIGS. 6A through 6E requires the rotating feature (601) to switch between rotating clockwise and anticlockwise. In one embodiment, the change of rotation direction of the rotating feature (601) may be gradual and non-abrupt. In one embodiment, the change of rotation direction of the rotating feature (601) may be immediate and abrupt. In an exemplary embodiment the rotation change of direction system may be controlled electronically using variable frequency drives (VFDs) or similar technology used to control the rotation speed and rotation direction of the rotating feature (601). In one embodiment, the rotation change of direction system may be controlled by mechanical systems, for example a gearbox, continuously variable transmissions (CVTs), or similar technology to control the rotation speed and rotation direction of the rotating feature (601). In one embodiment, the rotation change of direction system may be controlled by using a combination of electronic and mechanical systems to control the rotation speed and rotation direction of the rotating feature (601).

Similar to the rotating features (102, 103 and 104) illustrated in FIGS. 1A and 1B, the exemplary embodiment (601) of the rotating feature illustrated in FIGS. 6A, 6B, 6C, 6D, and 6E, may be indirectly driven for example if the rotating feature had one or more v-grooves for a belt drive system, one or more gears for a chain drive or geared system, one or more drive wheels or similar technology. In one embodiment, the rotating feature (601) may be directly driven with a straight shaft. In one embodiment, the rotating feature (601) may be directly driven with a straight shaft and flexible coupling or similar technology.

FIGS. 6A through 6E describe the exemplary embodiment in which the rotating feature changes direction of rotation in the context of a rotating feature with an open feature (607). It is also contemplated that the rotating feature may be accomplished without the open feature and/or in connection with any of the other alternative embodiments of the rotating feature described herein.

Figure 7A:
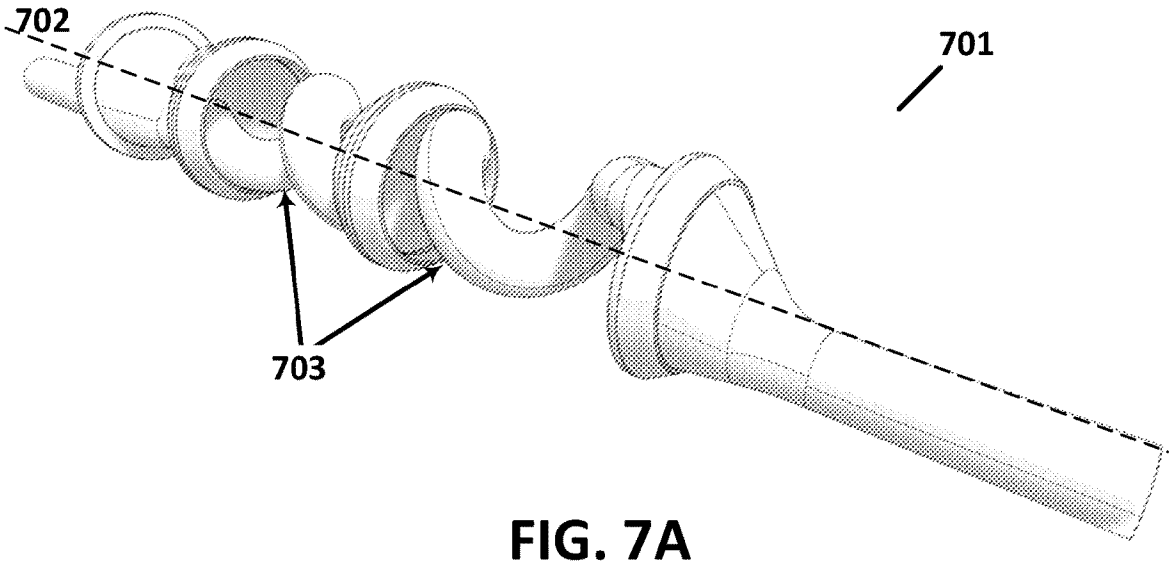
FIGS. 7A and 7B illustrate an exemplary embodiment of the rotating feature with a corkscrew path around a central axis.
Figure 7B:
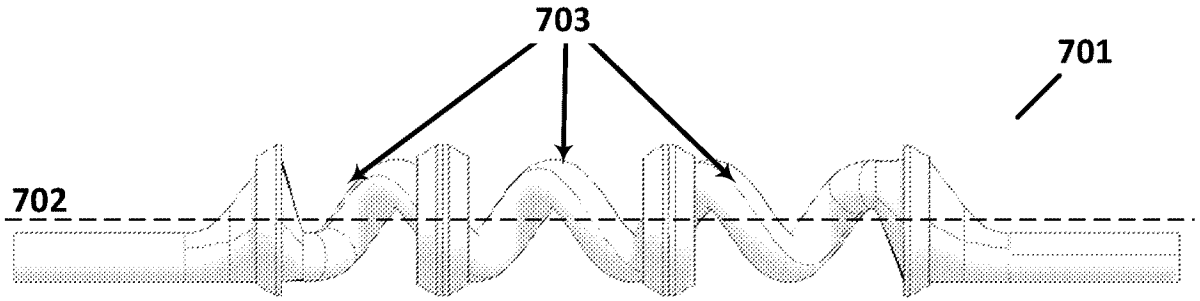

FIGS. 7A and 7B illustrate an exemplary embodiment of the rotating feature (701) with a corkscrew path (703). It is contemplated that the exemplary embodiment of the ride feature (701) or similar alternative embodiments may be used in place of any or all of the rotating features (102, 103 and 104) shown in FIG. 1A or alternative ride configurations.

FIGS. 7A and 7B illustrate an exemplary embodiment of the rotating feature (701) with a corkscrew path (703) around a central axis (702). In one embodiment, the corkscrew path (703) may follow a spline similar to that shown and described in connection with FIGS. 4A and 4B. In one embodiment, the cross-sectional diameter of the corkscrew path (703) may vary along the central axis (702) or spline similar to FIGS. 3A and 3B. In one embodiment, the rotating feature may have three-dimensional features on the inner ride surface similar to that shown and described in connection with FIGS. 5A and 5B. In one embodiment, the corkscrew pitch may vary along its length, i.e., be elongated or compressed.

FIGS. 8A through 8E illustrate an exemplary embodiment (801) of the rotating feature with multiple lanes. It is contemplated that the exemplary embodiment of the ride feature (801) or similar alternative embodiments may be used in place of any or all of the rotating features (102, 103 and 104) shown in FIG. 1A or alternative ride configurations.

Figure 8A:
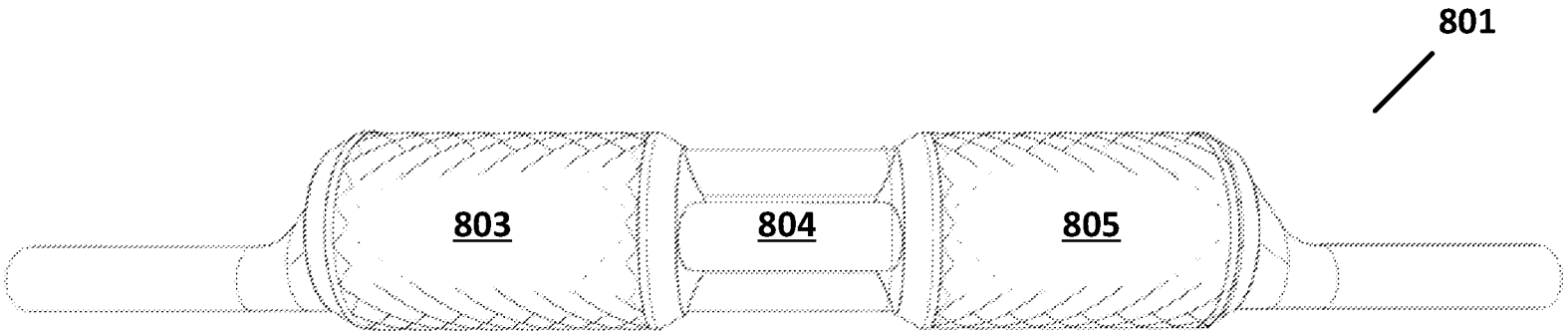
FIGS. 8A, 8B, 8C, 8D and 8E illustrate an exemplary embodiment of the rotating feature with multiple lanes and sections.
Figure 8B:
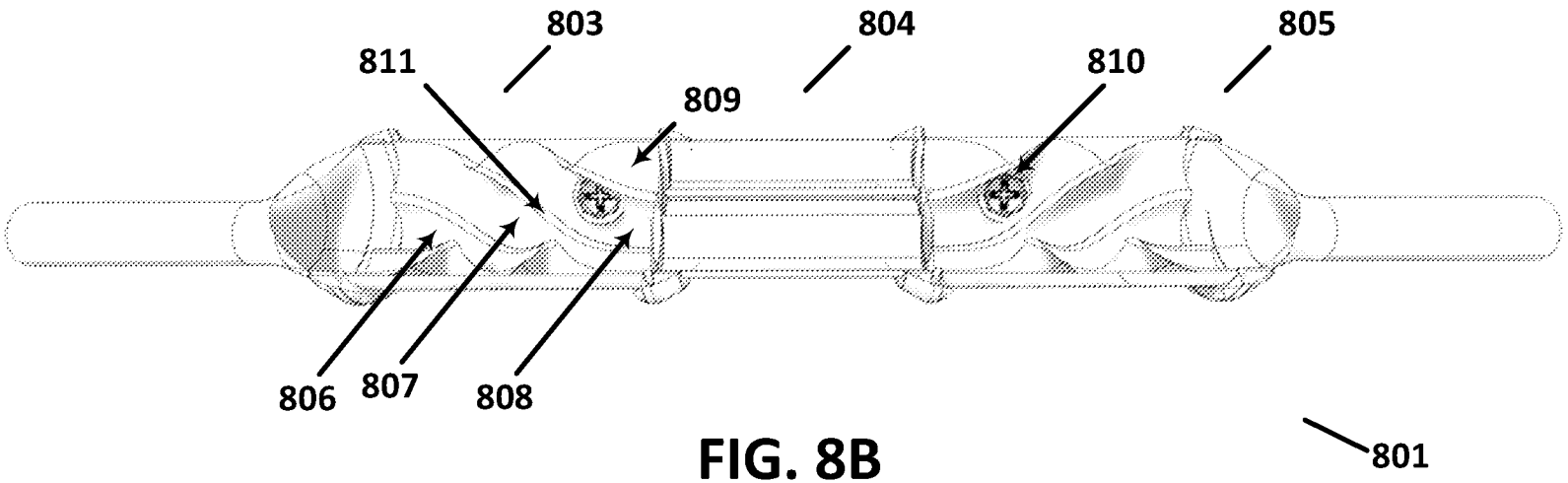

FIGS. 8A and 8B illustrate an embodiment with three joined sections (803, 804 and 805). FIG. 8B depicts the ride feature in FIG. 8A with a cutaway so that the entire of features 803, 804, and 805 can be seen. In other embodiments there may be more than three sections. In it is contemplated that this embodiment of the rotating feature preferably must start with section 803 and end with section 805, for example an embodiment may have a sequence starting with section 803, followed by 804, followed by another iteration of section 803, followed by another iteration of section 804, and so on, before finally ending with section 805. In one embodiment, the feature may only include one section similar to section 803 or section 805 as illustrated in FIG. 8D.

FIGS. 8A through 8E illustrate an embodiment with four lanes (806, 807, 808 and 809) that may be designed so that ride vehicles enter the rotating feature (801) every quarter rotation and allow multiple ride vehicles (810) to be in the rotating feature at once and improve the throughput of the ride. By providing lanes, the ride vehicle speed through the rotating feature may be controlled by restricting or maintaining progression of the ride vehicle through the rotating feature (801). That is, as the rotating feature (801) rotates, a ride vehicle that has progressed faster than expected will be inhibited by the lane separating feature (811); likewise, a ride vehicle progressing slower than expected will have its speed maintained as it is pushed along by the lane separating feature (811). In other embodiments the number of lanes may be two or more. In one embodiment, the lane separating features (811) are opaque; in other embodiments the lane separating features (811) may be transparent or semi-transparent over all or a portion of the length of the lane separating feature (811). In one embodiment, the lane separating feature may be of a height low enough that riders in one lane can see riders in an adjacent lane. In one embodiment, the lane separating feature may be sufficiently high that riders in one lane cannot see riders in an adjacent lane. In one embodiment, the height of the lane separating feature may vary along the length of the rotating feature.

Figure 8C:
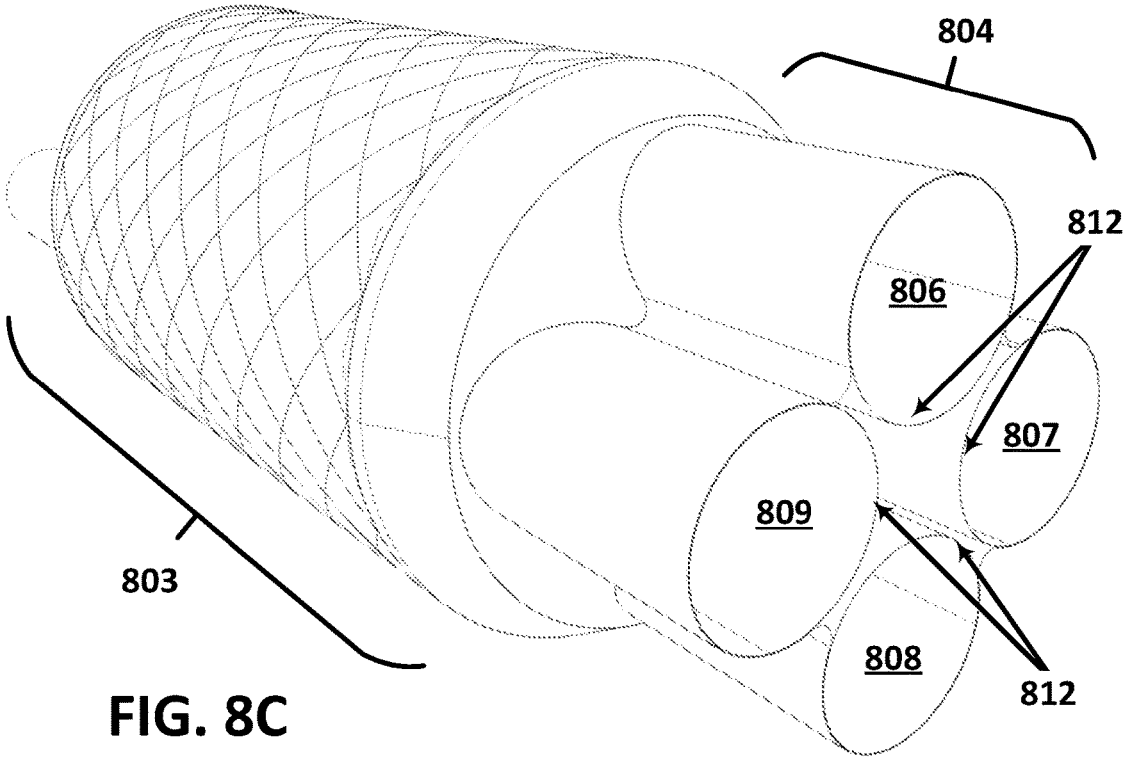
Figure 8D:
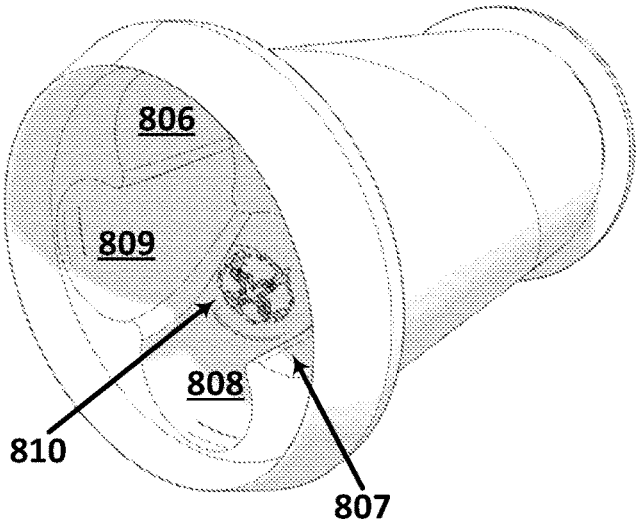
Figure 8E:
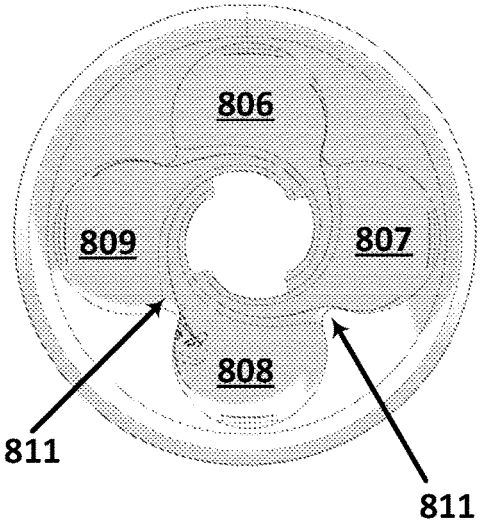

FIGS. 8A, through 8C illustrate an embodiment where riders within section 804 cannot see or interact with riders in neighboring lanes. In one embodiment, section 804 may have conjoined lanes with transparent or semitransparent dividing walls (812) similar to the experience described in connection with FIGS. 2-5 of international patent application publication number WO 2022/082293A1, titled "Amusement Attraction with Coupled Ride Paths," which is incorporated herein by reference.

In one embodiment, section 804 may have small apertures in the surface between adjoining lanes or piping between other lanes to allow riders to hear and interact with riders in other lanes similar to the experience also described in international patent application publication number WO 2022/082293A1. Sound from one lane may be heard in another lane. In one embodiment, section 804 may include apertures between lanes to transmit sound. In one embodiment, rather than or in addition to apertures, the material may transmit sound therethrough. In one embodiment, a mechanical and/or electronic system may transmit the sound from one ride area to another ride area and/or vice versa. For example, microphones and/or speakers may be used to transmit sound from one ride area to another ride area on the other side of the separation element and vice versa.

FIGS. 8A through 8C illustrate an embodiment where section 804 has straight sections with constant diameter inner and outer surfaces. In other embodiments the lanes within section 804 may not have straight sections with constant diameter inner and outer surfaces for example they may have varying inner and outer diameter as illustrated in FIGS. 3A and 3B, or follow a curved spline as illustrated in FIGS. 4A and 4B, or may follow a corkscrew path as illustrate in FIGS. 7A and 7B.

FIGS. 8A, 8B, 8C, 8D and 8E illustrate an embodiment in which each lane experiences the same ride. In another embodiment, each lane may have different experiences, such as by including different elements to enhance or alter the ride experience in that lane. For example a first lane (806) may have features similar to those shown in FIGS. 8A through 8E; a second lane (807) may have enhancement elements including three-dimensional shapes (e.g., moguls) and/or physical features within the lane similar to those described and shown in connection with FIGS. 5A and 5B; a third lane (808) may have sound, light and/or visual effect features; and a fourth lane 4 (808) may have gaming elements. Other elements may be incorporated in addition to or in place of these examples. For example, one lane might incorporate moguls and sound and light features. In another example, a lane might incorporate moguls and an outwardly offset spline. It is contemplated that any of the features described herein may be combined, as might be desired.

In one embodiment, the lanes may have different experiences in each section of the rotating feature. For example, section 803 may have gaming elements, section 804 may have sound, light and/or visual effect features and section 805 may have moguls and/or other physical features within the lanes, other additional sections may have other differing ride experiences. In one embodiment, each ride vehicle (810) in each lane may have different experiences in each section and have different experiences compared to the other lanes.

In all previously illustrated and described embodiments of the rotating feature (FIGS. 1 to 8) the quantity of water within the rotating feature may vary. The volume of water into each rotating feature (102, 103 and 104) may be manipulated through the use of additional water injection and dewatering sections prior to the rotating features. In one exemplary embodiment the water quantity may be such that it creates a deep channel of water. When combined with the rotating feature (102, 103 or 104) the deep channel of water may create a turbulent white water rafting type of experience, especially when paired with features on the inner ride surface such as three-dimensional shapes (e.g., feature 505 in FIGS. 5A and 5B).

In another exemplary embodiment of the rotating feature, the water quantity may be minimal to reduce the operational energy demands of the water pumps. In this embodiment, the friction between the ride vehicle and the ride surface should be sufficient to ensure safe operation. For example, the inner ride surface should be wet to the touch. In one embodiment, the ride vehicle may travel the length of the rotating feature and/or ride with a fixed volume of water, for example the volume of water may be released or injected into the ride or rotating feature to travel at approximately the same speed as the ride vehicle.

The interfaces between the rotating feature (e.g., feature 102 in FIGS. 1A and 1B) and the static intermediate features (e.g., feature 106 in FIGS. 1A and 1B) may be constructed such that water does not drain at the interface and continues down the rest of the water slide including into another rotating feature for example 103 in FIGS. 1A and 1B. In one embodiment, this may be achieved by designing the static downstream feature (e.g., feature 106) to overlap the rotating upstream feature (e.g., feature 102) on the outside at the joint so that the water falls into the downstream section, similar to a standard male-to-female pipe fitting. In one embodiment, a flexible marine shaft seal or similar technology may be used to join the rotating upstream (e.g., feature 102) and static downstream (e.g., feature 106) features such that there is little or no water loss where the sections meet. In one embodiment nozzles may be used to jet water into the rotating feature (e.g., feature 103) from the static upstream feature (e.g., feature 106).

Figure 9A:
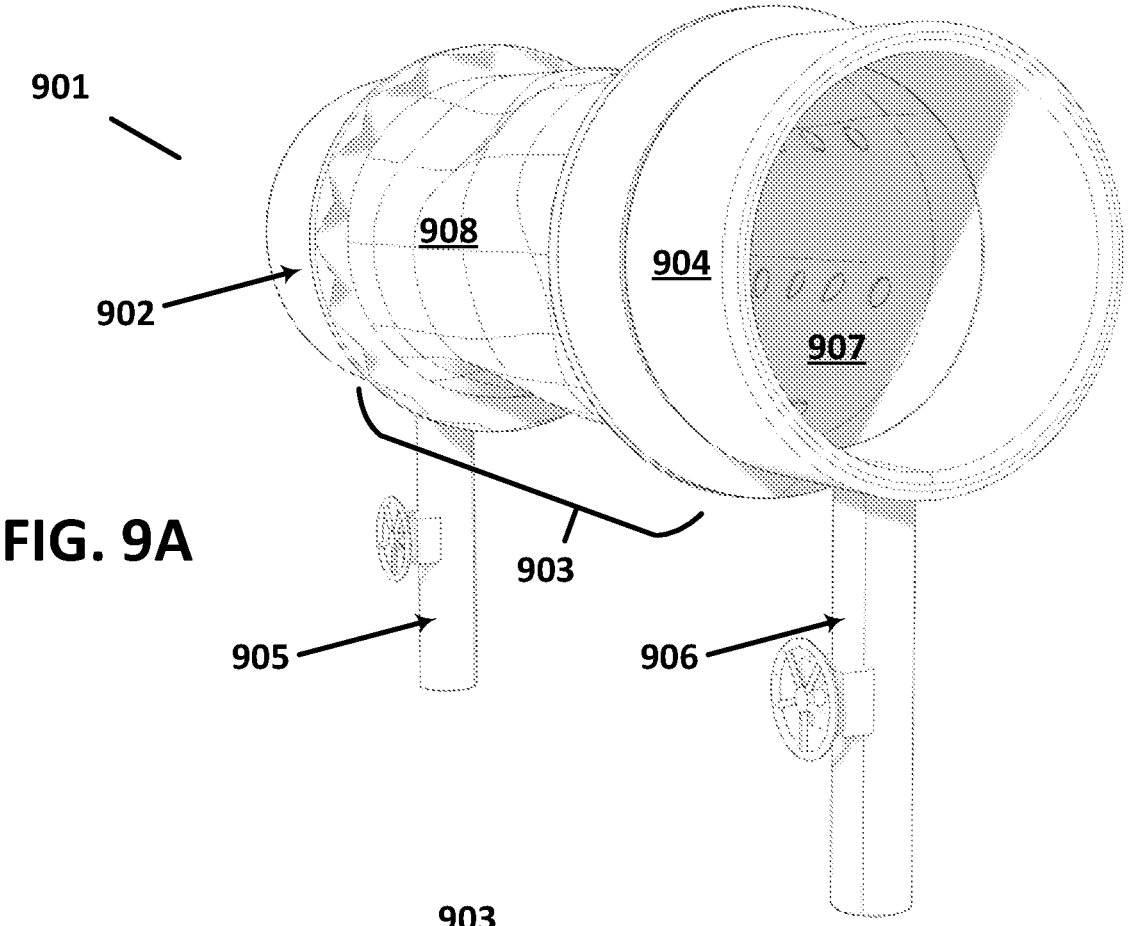
FIGS. 9A, 9B, 9C and 9D illustrate an exemplary embodiment of a water feed system for a rotating feature.
Figure 9B:
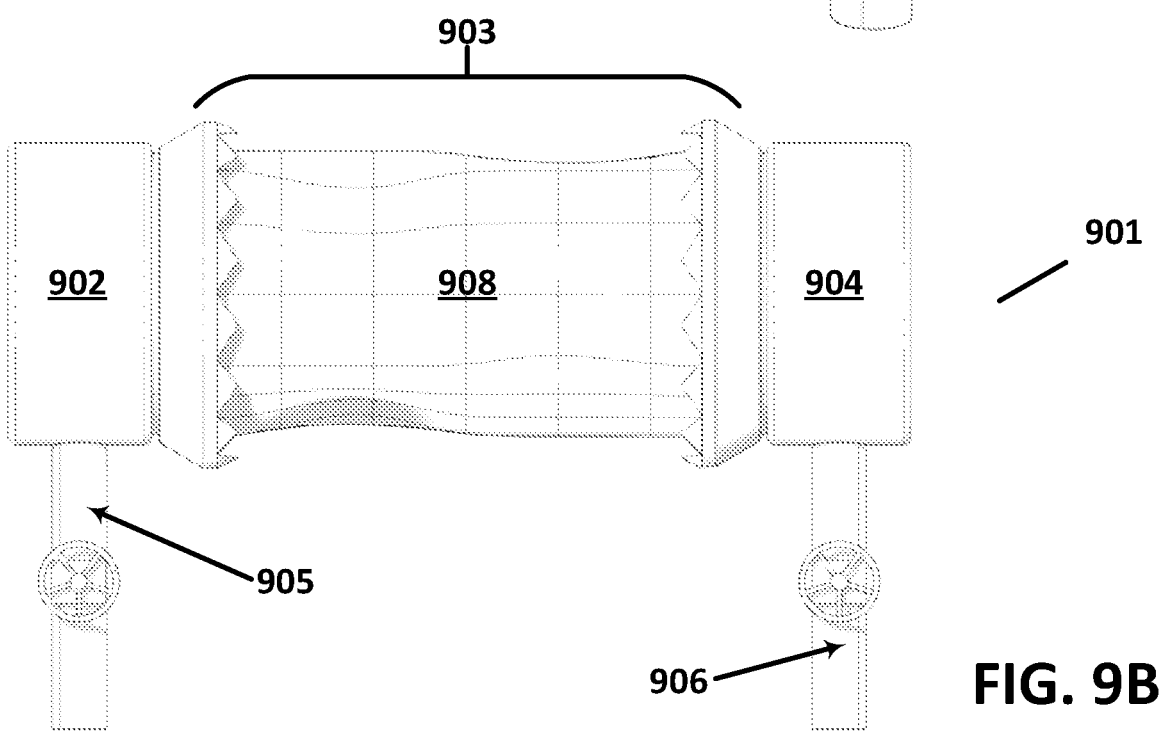
Figure 9C:
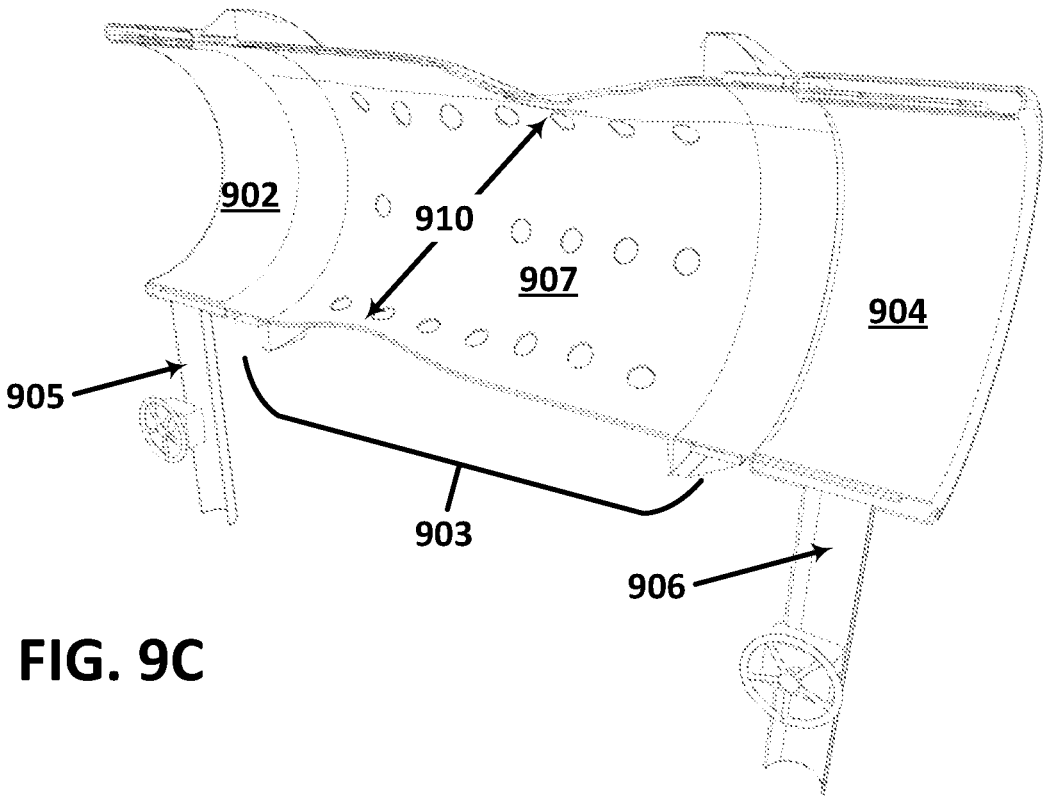
Figure 9D:
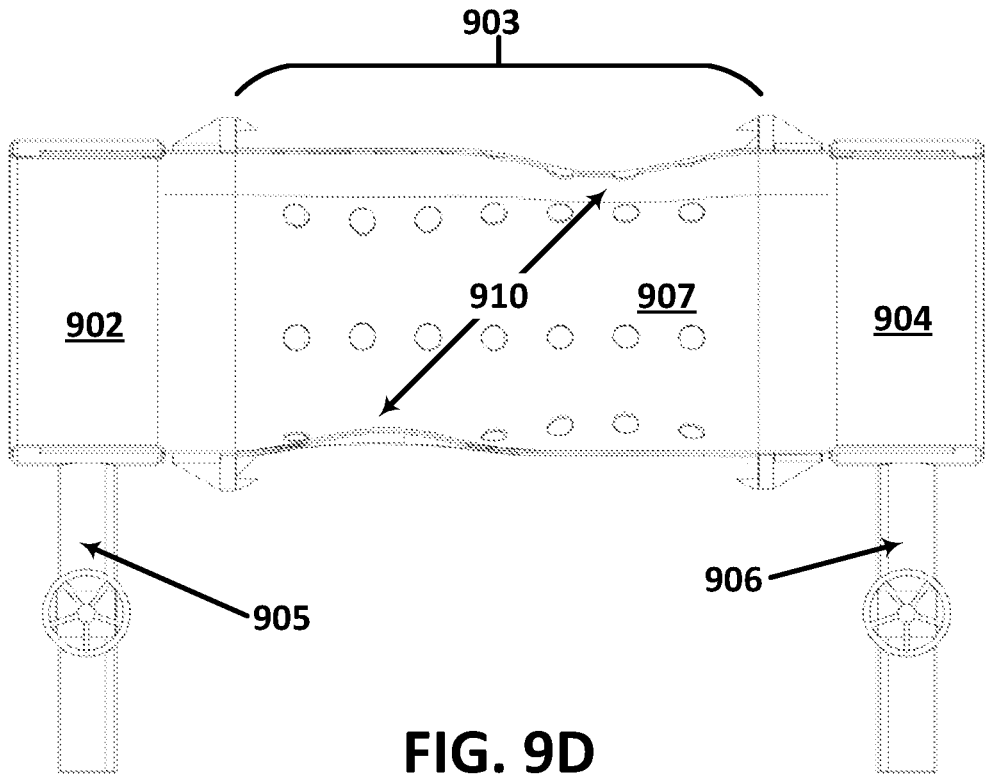

FIGS. 9A through 9D illustrate an exemplary embodiment of a water feed system for a rotating feature. FIG. 9A shows a perspective view of the embodiment; FIG. 9B shows a side elevation of the rotating feature; FIG. 9C shows a cutaway perspective view of the rotating feature; FIG. 9D shows a cutaway side elevation view of the rotating feature. It is contemplated that the exemplary embodiment of the rotating ride feature (901) or similar alternative embodiments may be used in place of any or all of the rotating features (102, 103 and 104) shown in FIG. 1A or alternative ride configurations.

FIGS. 9A through 9D illustrate an exemplary embodiment with an inlet section (902) with an inlet pipe (905), a main rotating feature (903) and an outlet section (904) with an outlet pipe (906). In one embodiment, the water inlet pipe (905) and outlet pipe (906) may be located in the same section, for example in section 902, and there is no outlet section (904) at the other end of the main rotating feature (903). In one embodiment, there may be more than one inlet (902) or outlet (903) section to a single rotating feature (901). In one embodiment, there may be more than one inlet (905) or outlet (906) pipe to a single inlet (902) or outlet (903) section.

FIGS. 9A through 9D illustrate an exemplary embodiment of a rotating feature (901) with an inlet section (902) and outlet section (904) that have a rotating inner ride surface (907) and a static outer surface (908). A cavity is formed between the inner surface (907) and outer surface (908) that allows water to flow from the inlet section (902) down the length of the rotating feature and to the outlet section (905). Water is supplied from the inlet pipes into the cavity between the inner surface and outer surface. As the rotating feature rotates, the water enters into the inner portion of the rotating features through apertures on the inner ride surface (907). Note that the apertures shown in FIGS. 9A, 9C, and 9D may be depicted with exaggerated size in order to facilitate understanding. In practice, the apertures may be much smaller than depicted in these figures. Typically, the apertures would be between 3 mm and 8 mm wide. As the inner surface (907) rotates, water may be carried partially up the walls of the rotating feature. Water will also flow out through the apertures and through the outlet pipes. In this manner, the static outer surface (908) allows the water inlet pipes (905) and water outlet pipes (906) to supply and remove water to and from the rotating feature (901) whilst the water pipes remain static. In one embodiment, the inlet section (902) and outlet section (904) are static, such that only the main rotating feature (903) between the inlet and outlet sections rotates.

FIGS. 9C and 9D illustrate an exemplary embodiment with a main central rotating feature with three-dimensional features (910) on the inner ride surface (907) similar to the embodiment 501 in FIGS. 5A and 5B. In one embodiment, the main rotating feature (903) may be replaced with any of the illustrated and described embodiments in FIGS. 1 to 8, as long as there is a cavity between the inner ride surface (907) and the outer surface (908) that is open at at least one end and can be joined to the inlet (902) and outlet (904) sections using a sealed join that can join static and rotating surfaces such as a marine shaft seal.

An alternative to the invention may be to make use of an Archimedes screw type of attachment to the rotating tube, such that the rotation of the barrel may be capable of transporting a vehicle up an incline while simultaneously carrying a segment of water. The embodiment described in connection with FIGS. 8D and 8E may be especially useful in this scenario. There are prior examples of this approach for uphill conveyance but none where the screw feature is added as a separate add-on to a spinning base.

As used herein, the terms "about," "substantially," or "approximately" for any numerical values, ranges, shapes, distances, relative relationships, etc. indicate a suitable dimensional tolerance that allows the part or collection of components to function for its intended purpose as described herein. Numerical ranges may also be provided herein. Unless otherwise indicated, each range is intended to include the endpoints, and any quantity within the provided range. Therefore, a range of 2-4, includes 2, 3, 4, and any subdivision between 2 and 4, such as 2.1, 2.01, and 2.001. The range also encompasses any combination of ranges, such that 2-4 includes 2-3 and 3-4.

Although embodiments of this invention have been fully described with reference to the accompanying drawings, it is to be noted that various changes and modifications will become apparent to those skilled in the art. Such changes and modifications are to be understood as being included within the scope of embodiments of this invention as defined by the appended claims. Specifically, exemplary components are described herein. Any combination of these components may be used in any combination. For example, any component, feature, step or part may be integrated, separated, sub-divided, removed, duplicated, added, or used in any combination and remain within the scope of the present disclosure. Embodiments are exemplary only, and provide an illustrative combination of features, but are not limited thereto.

When used in this specification and claims, the terms "comprises" and "comprising" and variations thereof mean that the specified features, steps, or integers are included. The terms are not to be interpreted to exclude the presence of other features, steps, or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the invention in diverse forms thereof.

Unless the context clearly requires otherwise, throughout the description and the claims, the words "comprise," "comprising," and the like are to be construed in an inclusive sense as opposed to an exclusive or exhaustive sense; that is to say, in a sense of "including, but not limited to." Words using the singular or plural number also include the plural or singular number respectively. Additionally, the words "herein," "hereunder," "above," "below," and words of similar import refer to this application as a whole and not to any particular portions of this application. When the word "or" is used in reference to a list of two or more items, that word covers all of the following interpretations of the word: any of the items in the list, all of the items in the list and any combination of the items in the list.

The above descriptions of illustrated embodiments of the system, methods, or devices are not intended to be exhaustive or to be limited to the precise form disclosed. While specific embodiments of, and examples for, the system, methods, or devices are described herein for illustrative purposes, various equivalent modifications are possible within the scope of the system, methods, or devices, as those skilled in the relevant art will recognize. The teachings of the system, methods, or devices provided herein can be applied to other processing systems, methods, or devices, not only for the systems, methods, or devices described.

The elements and acts of the various embodiments described can be combined to provide further embodiments. These and other changes can be made to the system in light of the above detailed description.

In general, in the following claims, the terms used should not be construed to limit the system, methods, or devices to the specific embodiments disclosed in the specification and the claims, but should be construed to include all processing systems that operate under the claims. Accordingly, the system, methods, and devices are not limited by the disclosure, but instead the scope of the system, methods, or devices are to be determined entirely by the claims.

While certain aspects of the system, methods, or devices are presented below in certain claim forms, the inventors contemplate the various aspects of the system, methods, or devices in any number of claim forms. Accordingly, the inventors reserve the right to add additional claims after filing the application to pursue such additional claim forms for other aspects of the system, methods, or devices.

While preferred embodiments of the present invention have been shown and described herein, it will be obvious to those skilled in the art that such embodiments are provided by way of example only. Numerous variations, changes, and substitutions will now occur to those skilled in the art without departing from the invention. It should be understood that various alternatives to the embodiments of the invention described herein may be employed in practicing the invention. It is intended that the following claims define the scope of the invention and that methods and structures within the scope of these claims and their equivalents be covered thereby.

The invention claimed is:

1. A water ride feature, comprising:

a rider entrance;

a rider exit;

a ride surface adapted to carry one or more riders or ride vehicles sliding thereon from the rider entrance to the rider exit, wherein the ride surface comprises a fully enclosed tube section with a consistent cross-sectional diameter, and wherein the water ride feature is configured to be rotated around a central longitudinal axis, and wherein when there is a change in a direction of rotation of the water ride feature around the central longitudinal axis, the one or more riders or ride vehicles continue from the rider entrance to the rider exit.

2. The water ride feature of claim 1, wherein a rotation speed of the water ride feature is variable.

3. The water ride feature of claim 1, wherein the fully enclosed tube section follows a curved spline.

4. The water ride feature of claim 3, wherein the curved spline is a corkscrew shape.

5. The water ride feature of claim 1, further comprising one or more three-dimensional features disposed on the ride surface.

6. The water ride feature of claim 5, comprising a plurality of three-dimensional features disposed on the ride surface, and wherein each of the plurality of three dimensional features are identical and distributed uniformly throughout the ride surface.

7. The water ride feature of claim 1, wherein the ride surface further comprises a cross-sectional diameter wherein the cross-sectional diameter of the ride surface varies along the length of the ride feature.

8. The water ride feature of claim 1, wherein the change in the direction of rotation of the water ride feature around the central longitudinal axis is smooth and not abrupt.

9. A water ride feature, comprising:

a rider entrance;

a rider exit;

a ride surface adapted to carry one or more riders or ride vehicles sliding thereon from the rider entrance to the rider exit, wherein the ride surface comprises a fully enclosed tube section with a consistent cross-sectional diameter, and wherein the water ride feature is configured to be rotated around a central longitudinal axis, and wherein the water ride feature is configured to switch between rotating clockwise and rotating anticlockwise when the one or more riders or ride vehicles continue to slide on the ride surface from the rider entrance to the rider exit.

10. The water ride feature of claim 9, wherein a rotation speed of the water ride feature is variable.

11. The water ride feature of claim 9, further comprising one or more three-dimensional features disposed on the ride surface.

12. The water ride feature of claim 11, comprising a plurality of three-dimensional features disposed on the ride surface, and wherein each of the plurality of three dimensional features are identical and distributed uniformly throughout the ride surface.

13. The water ride feature of claim 9, wherein the switch between rotating clockwise and rotating anticlockwise is smooth and not abrupt.

* * * * *